US008048234B2

(12) United States Patent
Jacquinet

(10) Patent No.: US 8,048,234 B2
(45) Date of Patent: Nov. 1, 2011

(54) METHOD OF CLEANING PIPES BY ACTION OF A FLUID UNDER VERY HIGH PRESSURE

(75) Inventor: Rene Jacquinet, Nilvange (FR)

(73) Assignee: Application Lorraine des Techniques Nouvelles - Technilor SAS, Hagondange (FR)

( * ) Notice: Subject to any disclaimer, the term of this patent is extended or adjusted under 35 U.S.C. 154(b) by 289 days.

(21) Appl. No.: 12/443,893

(22) PCT Filed: Aug. 20, 2007

(86) PCT No.: PCT/FR2007/051833

§ 371 (c)(1),
(2), (4) Date: Apr. 1, 2009

(87) PCT Pub. No.: WO2008/023133

PCT Pub. Date: Feb. 28, 2008

(65) Prior Publication Data

US 2010/0083988 A1 Apr. 8, 2010

(30) Foreign Application Priority Data

Aug. 21, 2006 (FR) ..... 06 53410

(51) Int. Cl.
*F28G 1/16* (2006.01)

(52) U.S. Cl. ..... 134/22.12; 134/22.11; 134/24; 134/167 C

(58) Field of Classification Search ..... None
See application file for complete search history.

(56) References Cited

U.S. PATENT DOCUMENTS

| | | | | |
|---|---|---|---|---|
| RE26,659 | E | 9/1969 | Siegal | |
| 6,626,195 | B1 * | 9/2003 | Garman et al. | 134/104.1 |

FOREIGN PATENT DOCUMENTS

| | | | |
|---|---|---|---|
| DE | 124424 | C | 10/1901 |
| DE | 8415401.2 | U1 | 4/1993 |
| FR | 2643291 | A1 | 8/1990 |
| WO | 02/059538 | A1 | 8/2002 |
| WO | WO 02059538 | A1 * | 8/2002 |
| WO | 2005/032725 | A2 | 4/2005 |

OTHER PUBLICATIONS

International Search Report of PCT/FR2007/051833.

* cited by examiner

*Primary Examiner* — Michael Barr
*Assistant Examiner* — Caitlin N Dennis
(74) *Attorney, Agent, or Firm* — Westerman, Hattori, Daniels & Adrian, LLP

(57) ABSTRACT

The invention relates to a method of cleaning a pipe (12) by action of a fluid under very high pressure. It is characterised in that the fluid under very high pressure is caused to pass in a flexible tube (14); said tube is subjected to the action of motorisation means (5) for longitudinal advance, and means for driving the tube (14) in rotation around its longitudinal axis; these motorisation means (50) are regulated by management means (48) and rotation detection means (47) and/or pinpointing longitudinal advance, and these means of driving in rotation; the tube (14) is guided near the entrance of the pipe (12). The invention also relates to a device for implementing this method.

17 Claims, 4 Drawing Sheets

METHOD OF CLEANING PIPES BY ACTION OF A FLUID UNDER VERY HIGH PRESSURE

The present invention relates to a method for cleaning pipes by the action of a fluid under very high pressure.

It relates to a device for cleaning with high-pressure fluid, namely for implementing this method.

It also relates to a rotary casing for a device for cleaning with high-pressure fluid.

The present invention falls within the field of hydrodynamics.

The invention relates in particular to the installations for cleaning under very high pressure of industrial plants.

In particular, the cleaning of the pipes of condensers, exchangers or similar devices, generically referred to as water boxes in the following description, or also any internal cleaning of pipes requires the implementation of apparatus of a particular technology. Scale formation in pipes is an economical plague, which results into a considerable loss of efficiency of the plants; thus, a 2% loss on a section of a 1000 MW nuclear power plant represents a loss of 20 MW.

Cleaning systems referred to as <<Roto-Jet®>> or <<Roto-Fan®>> are known, in which a cleaning head, often referred to as rabbit, generally made of steel and provided with holes, is propelled into the conduit to be cleaned by the pressure of the fluid thanks to holes generating propelling jets. The pressure drives the head in rotation, through slanted holes generating jets for causing the rotation, as well as the flexible tube supplying same. The cleaning itself occurs under the action of these jets as well as of jets eventually created at the level of other complementary holes.

The driving of the tube thus results from the control in rotation of the cleaning head under the action of the hydraulic pressure or under the impulse of a motor this head is provided with. However, when the rotation occurs under a hydraulic effect, it is obvious that there is a loss of cleaning efficiency due to the hydraulic power absorbed for driving the head. Providing a cleaning head with an electric motor imparts to the letter a cross-section limiting its use by not allowing its use in pipes having a very small diameter.

Now, the scale formation in the pipes reduces very much their diameter. For example, one usually observes, in coolers for nuclear plants with bundles of pipes having a 18 mm diameter, a passage limited to about 8 mm, this over lengths of for example 16 m. In addition, the scale formation is not regular, and one generally observes the presence of beads, which further reduce the passing to a value between 4 and 6 mm, when they do not completely obstruct the pipe.

This leads to a limitation of the diameter of the heads used for removing the scale. This limitation of the diameter therefore also leads to a limitation of the power that can be supplied for the scale-removing operation, the more that a large portion of the power is consumed for propelling the scale-removing head in the pipe. It is therefore usual, with such heads, that the pressure must be limited within the framework of the above example. Moreover, these prior-art heads, generally made of steel, include fluid-injection holes for generating jets, which are quickly worn out. Furthermore, these small-diameter holes are drilled and often striated, because their boring is difficult to be performed correctly. Because of the materials used, it is impossible to guarantee maintaining these holes over a long period of time and, because of the reduced lifetime of these holes, it is very random to maintain the required pressure at the exit of the hole. The reproducibility of the cleaning is in addition not guaranteed.

Such systems, suitable for small and middle-size lengths, i.e. less than 10 to 15 meters, are less suitable for larger-size plants. The phenomena of torsion of the tube and the existence of shocks in the flexible tubes damage them quickly.

For condensers that can group for example 120,000 pipes having a length of 16 meters, other technological solutions should be implemented. In particular, the selection of very high pressure systems, for example 38 $10^7$ Pa, feeding the <<Roto-Jet®>> has been contemplated This high pressure allows eliminating the scale formations that can substantially reduce the useful cross-section of the pipe, even obstruct the latter. Unlike with the above-mentioned systems, the constraints regarding the length of the flexible tubes have here a particular acuity; to the linear tubular length itself should indeed be added 5 to 6 meters for the bends and an extra length for the putting into rotation. Such flexible tubes can thus reach a length of about thirty meters. It is thus very difficult to overcome the phenomena of torsion of such flexible tubes.

For machining and maintenance operations inside pipes, rigid systems are known, which are well-suited for short and middle-size lengths of a few meters (4 to 5) and for pipe diameters of a few tens of mm. Various types of machine-tools, such as inside grinding machines, drilling machines or also lapping machines, include a tool mounted on the outer side of the rigid pipe. The tool is then either mounted so as to rotate at the end of this rigid pipe, which is in turn carried by a carriage providing a longitudinal forward movement, in the case of grinding machines, as can be seen in WO 97/27955, or mounted integral with a rotary pipe, in the case of drilling machines, with, in this case, intermediary restart bearings, or also in the case of lapping machines, the rotary rigid pipe being, in the latter case, driven by a gimballed system integral with a longitudinal forward-movement carriage. GB 1118018 or U.S. Pat. No. 5,460,563 show such configurations of tools mounted at the end of rigid pipes driven in rotation. Such installations require rigid pipes dimensioned so as to withstand bending and pull resistances resulting into high torsion stresses. These rigid pipes necessarily have a diameter very close to that of the bore to be machined or to be maintained, in the range of 0.8 to 0.9 times its diameter, and a large cross-section.

Attempts to manufacture telescopic rigid tubes driven in translation and in rotation, as in the case of JP2000117202, are still limited in length and to a strictly rectilinear extension of the tube.

All these embodiments with rigid tubes still have the drawback of a bulky size, voluminous motorisation and guiding infrastructures, which do not permit their installation in the immediate vicinity of industrial plants as water boxes the spatial environment of which does not permit to do so.

In brief, only the rigid tubes are designed to be driven in rotation over their full length, in combination with a longitudinal translation movement, but their size does not permit to use them for maintenance of most industrial plants.

The existing flexible tubes that would be suitable for such maintenance operations include a rotary tool at the end, but are, in turn, driven neither in rotation over their full length nor in longitudinal translation.

In brief, according to the prior art, it is impossible to control or regulate the speed of rotation of the head about its axis, at certain angles of inclination of the jets with respect to the head, the latter rotates at too high a speed, which is prejudicial for high-quality machining. It is impossible to adjust the angle of exit of the jet with respect to the head and to adjust the flow rate of the jet of fluid projected through the nozzles.

Furthermore, the known state-of-the-art systems have a slow forward movement resulting into a duration of the path of the head during cleaning in the range of 15 minutes for a pipe having a diameter of 18 millimeters and a length of 15 meters. In particular, they perform a bad cleaning, since the forward movement is not uniform. Such non-uniformly cleaned pipes are therefore inclined to favour a quicker formation of scale as soon as they are put back into operation, in the form of beads.

The invention is aimed at coping with the drawbacks of the state of the art by providing a device permitting to control the rotation of a flexible tube over its full length as well as its translation, so as to optimise the use of power in order to dedicate as much as possible of it to the cleaning function and not to the driving and putting into rotation of the head, which are not productive per se.

To this end, the invention relates to a method for cleaning a pipe by the action of a fluid under very high pressure, characterised in that:

- said fluid under very high pressure is caused to pass through a flexible tube
- said flexible tube is subjected to the action of motorisation means for longitudinal advance and to the action of means for driving said tube in rotation about its longitudinal axis
- said motorisation means for longitudinal advance and said means for driving said tube in rotation are regulated by means of management means and means for detecting the rotation and/or pinpointing the longitudinal advance
- said tube is guided near the entrance of said pipe.

The invention also relates to a device for cleaning with a fluid under high pressure, namely for cleaning bundles of pipes such as an exchanger or the like, including means for generating a fluid under very high pressure for feeding a tube, characterised in that it includes motorisation means for longitudinally advancing said tube, first front means for driving said tube in rotation about its longitudinal axis designed capable of being located near said bundle of pipes, and at least second rear means for driving said tube in rotation about its longitudinal axis interposed between said front means for driving in rotation and said means for generating.

According to a feature of the invention, said first front means for driving in rotation are synchronised with said rear means for driving in rotation.

According to another feature of the invention, said tube is flexible.

According to another feature of the invention, said front means for driving in rotation are formed by a rotary casing.

The invention also relates to such a rotary casing, in which a tube is designed capable of being inserted and guided, characterised in that it includes means for connecting to said tube, integral in rotation, a rotor driven in its rotation motion about a longitudinal axis corresponding substantially to the longitudinal axis of the tube designed capable of passing through this rotor, by front means for driving in rotation with respect to a fixed crankcase.

According to a particular feature, said connecting means are motorisation means for longitudinally advancing said tube.

According to another feature, said device includes a head designed capable of projecting a cleaning jet at one end of said tube, fixed to said end of said tube, and including at least one internal channel designed capable of bringing fluid under pressure to at least one insert designed capable of generating outside said head at least one jet of fluid.

Further features and advantages of the invention will become clear from the following detailed description of non-restrictive embodiments of the invention, with reference to the attached drawings, in which:

FIG. 1 schematically represents a partial view from above of a device for cleaning with a fluid under high pressure according to the invention, including rotary casings according to the invention;

FIG. 2 is a schematic perspective view, partially in cross-section, of the device represented in FIG. 1;

FIG. 3 schematically represents an elevation view of a detail of the circuit for supplying with fluid the cleaning device with fluid under high pressure according to the invention;

FIG. 4 schematically represents a longitudinal cross-sectional and elevation view of the cleaning device with fluid under high pressure and the rotary casing according to the invention;

Figure 2:
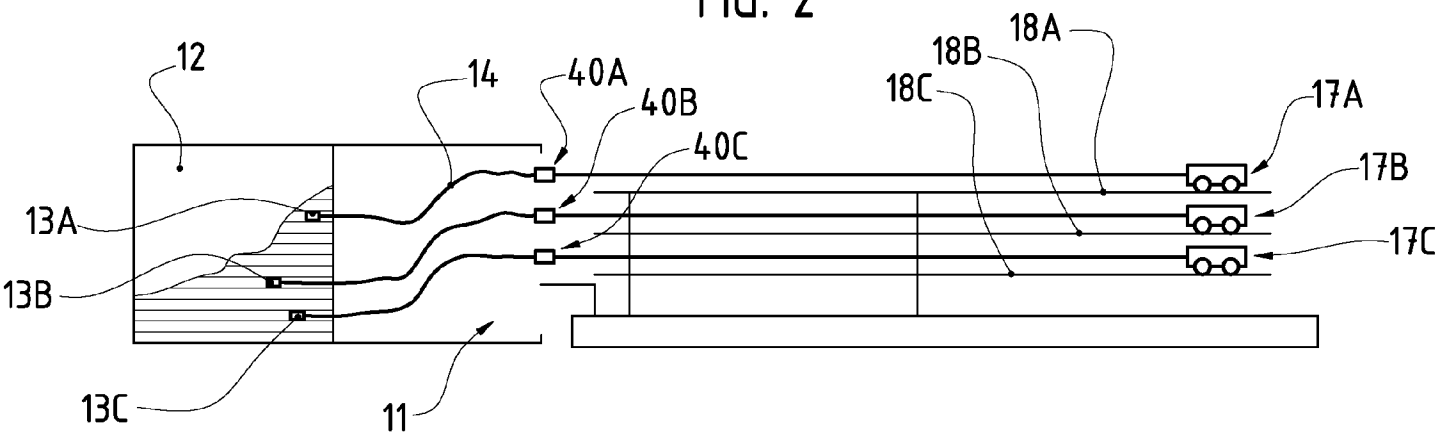

The present invention falls within the field of hydrodynamics.

It relates in particular to the maintenance of industrial plants, in particular the cleaning of pipes of condensers, exchangers, water boxes or the like.

The invention consists in developing a method for performing these operations for cleaning a pipe 12 under the action of a fluid under very high pressure, and a device 10 for implementing this method.

This method includes the following operations:

- a fluid under very high pressure is caused to pass through a flexible tube 14
- this flexible tube 14 is subjected to the action of motorisation means 50 for longitudinal advance and to the action of means for driving said tube 14 in rotation about its longitudinal axis
- the motorisation means 50 for longitudinal advance and said means for driving said tubes 12 in rotation are regulated by means of management means 48 and means for detecting the rotation 47 and/or pinpointing the longitudinal advance
- said tube 14 is guided near the entrance of said pipes 12.

Preferably, the circulation of the fluid in the tube 14 is controlled by these management means 48.

Figure 1:
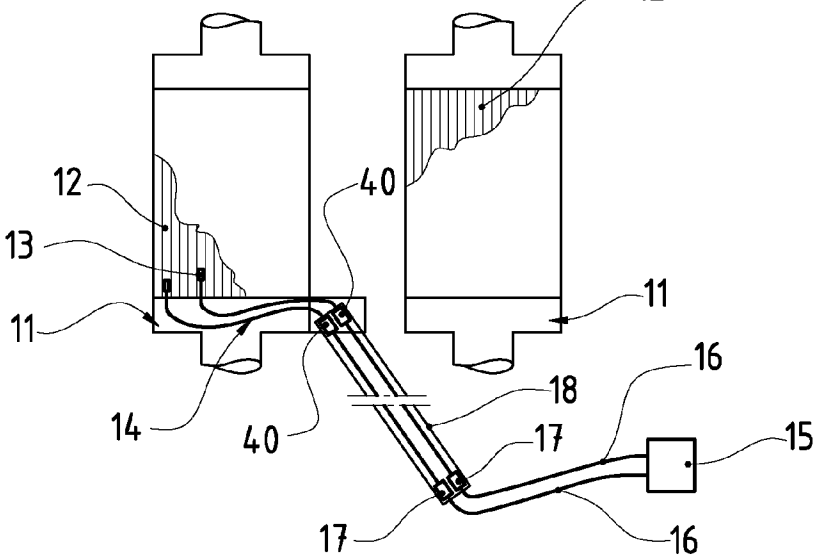

A device for conveying 10 fluid under very high pressure, as can be seen in FIG. 1, is designed for cleaning and/or scale removal in an industrial plant 11, such as a water box, including a bundle of pipes 12.

The cleaning and/or scale removal of each of these pipes 12 is ensured by a head 13, such as a tip, a <<Roto-Jet®>>, a rabbit or the like. Through this head 13 passes a fluid under very high pressure, namely water, supplied to same by a tube 14 from generating means 15, which feed a supply conduit 16, which is connected to the tube 14 through connecting means 20.

In a preferred embodiment, these generating means 15 are a compressor supplying fluid under very high pressure, namely between 1500 and 3800 bar, with a flow rate of a few liters per minute, within a preferred range comprised between 10 and 15 liters per minute, these values being in no way restrictive.

Due to the aimed combination of a very high pressure and a very low flow rate, the head losses are very small and almost all power is available at the level of the head 13.

According to the invention, the tube 14 is preferably a flexible tube designed to run over the full length of the pipes 12 and to fit the topology of the plant 11 to be maintained.

This length can be very large, it is therefore necessary to guide the tube 14, in order to guarantee both the proper operation of the device 10 and its safety. To this end, the device 10 includes motorisation means 50 for the longitudinal advance of the tube 14, and means for driving the tube 14 in rotation about its longitudinal axis.

This arrangement allows dedicating the total energy under high pressure sent into the head 13 to the cleaning operation itself.

Figure 7:
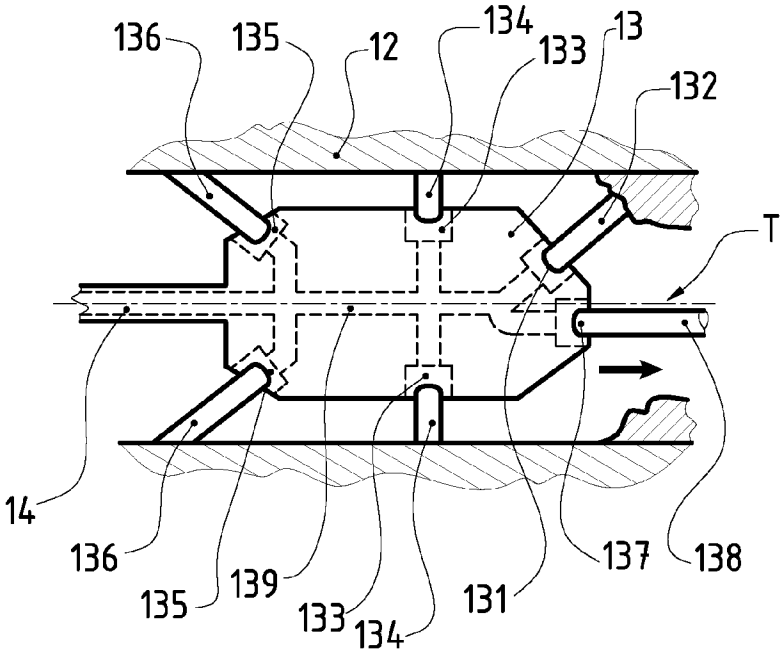
FIG. 7 is a schematic representation of a cleaning head according to the invention, in a scale-covered pipe shown in a longitudinal cross-sectional view.

As can be seen in FIG. 7, in a preferred and non-restrictive application the head 13 is fixed at the end of the tube 14. This head 13 preferably includes a longitudinal axis T. When the tube 14 provided with the head 13 is inserted into a pipe 12, this axis T is parallel to that of the pipe 12. In this respect, it should be noted that the invention is perfectly suitable for maintenance of pipes 12 of any shape whatsoever, even though these pipes 12 are usually rectilinear. In the case in which the pipe 12 has a bend, the axis T is parallel to the tangent to this bend at the point where the head 13 is present in the pipe 12. The head 13 is designed capable of projecting a cleaning jet at an end of the tube 14 to which it is fixed, opposite the end through which this tube is fed by the generating means 15. The head 13 includes at least one internal channel 139 designed capable of bringing fluid under pressure to at least one insert designed capable of generating, outside the head 13 and namely inside a pipe 12 to be cleaned, at least one jet of fluid. This internal channel 139 can include, as can be seen in FIG. 7, diversion channels feeding with fluid under pressure various inserts, which are in turn designed capable of generating as many jets of fluid.

At least one front insert 131 oriented according to an angle, preferably between 15° and 20°, with respect to the longitudinal axis T of the head 13 is designed capable of carrying out, with the jet 132 it projects downstream of the head 13, i.e. in front of the latter in its forward movement in the pipe 12, the pickling of the scale or the like. In an advantageous version, this angle of orientation is adjustable. The insert 131 can advantageously be complemented with at least another front insert 137, substantially parallel to said axis T and offset with respect to the latter, which is designed capable, together with the jet 138 it also projects upwards of the head 13, of breaking the scale or similar near the axis T, which is preferably parallel to that of a pipe 12 in which the tube 14 provided with the head 13 is inserted, in order to clean it.

Indeed, thanks to a set of side inserts 133 projecting side jets 134, namely onto the wall of a pipe 12, the head 13 is and remains perfectly centred about the axis of the pipe 12, unlike the prior-art devices, in which the cleaning head has an irregular, helically shaped path, the irregularity is amplified by the speed of rotation, namely beyond 200 revolutions per minute. These inserts 133 can, as the case may be, be radial or be oriented according to an angle of 80 to 90° with respect to the axis T, so as, like the insert 131, to project their jet forward in the direction of working progression AV of the head 13. Preferably, the side inserts 133 are arranged regularly at the circumference of the head 13, in order to ensure its hold through the balance of the jets they generate. They are advantageously three in total.

One or several rear inserts 135 are designed capable of projecting downward of said head 13, i.e. to the side opposite to the upward side, or also behind the head when it progresses in a pipe 12, one or several jets 136, in order to at least compensate for the axial forces due to one or several jets oriented upstream of the head 13 and coming from other inserts the latter includes, and namely jets coming from other inserts 131 or/and 133. The side inserts 133 are advantageously arranged regularly at the circumference of the head 13. They are preferably three in total.

The energy brought through the tube 14 to the head 13 is, preferably and in no way restrictively, distributed as follows:

- a little more than 50%, preferably between 50 and 60%, in particular 55%, at the level of the rear inserts 135;
- between 20 and 40%, preferably 30%, at the level of the side inserts 133;
- between 10 and 20%, preferably 15%, at the level of the front insert 131, or of the front inserts 131 and 137.

One thus understands that, according to the invention, the tube 14 is moved in translation in the pipe 12 to be cleaned under the action of the motorisation means 50, and that it is useless to cause to pass through the rear inserts 135 of the head 13 an energy for its propelling, which could be better used for cleaning. According to the invention, the distribution of energy in the jets coming from the inserts of the head 13 is calculated so as to ensure, if not its balance in the pipe 12, which is not aimed at because of the danger of bursting of the pipe 12 in case of an extended stay of the head at some location, at least a slight pulling force in the direction AV of progress of the head 13 in the pipe. The advance movement in working speed of the head 13 in the pipe is in turn brought about under the action of the motorisation means 50.

Preferably, the inserts, and in particular the inserts generating the jets that perform the cleaning work, i.e. the front inserts 131 or/and 137, are made out of hard material, having a hardness of more than 2000 megapascals and drilled to a calibrated diameter of a low value, lower than 0.150 mm, and preferably lower than 0.100 mm. In a preferred application, these inserts are made of sapphire, of a long lifetime.

Thus, thanks to the perfect axial stabilisation of the head 13 in a pipe 12, the cleaning energy can be brought exactly to the desired location.

According to the application, depending on the diameter of the pipe 12 to be cleaned and the extent of soiling of the material to be cleaned, the user selects a head 13 of a suitable diameter and morphology. In particular the shooting angles of the various jets can be changed according to the position and orientation of the various inserts.

The means for driving the tube 14 in rotation permit, in combination with the means for driving the head 13 in translation in the pipe 12 under the action of the motorisation means 50, to provide an extremely regular path. This is essential in order to perform a complete and perfect cleaning of the pipes 12. This regularity has also another important advantage, in the case in which the wall of a pipe 12 has a local weakening due to a previous bad-quality treatment: the regular advance of the head 13 allows a proper cleaning of this weakened area, without weakening it even more or even causing it to burst, which was the case with the prior-art devices.

It should also be noted, in this respect, that the selection of a very high pressure conjugated with a very low flow rate of fluid, conjugated with a very small diameter of the inserts designed capable of generating fluid jets, allows achieving at the exit of the latter jets having a very short length of action, namely shorter than 10 millimeters, sufficient for cleaning the pipe 12. This small jet length is important when the head 13 circulates in a pipe 12 that has a burst for any reason whatsoever, since the jets coming from the head 13 do not damage the other pipes 12 near the one on which one is operating, within the bundle of pipes usual in such a case.

In a preferred embodiment, the device 10 includes first front means 44 for driving the tube in rotation about its longitudinal axis designed capable of being located near the bundle of pipes 12. It also includes at least second rear means 33 for driving the tube 14 in rotation about its longitudinal axis, which are interposed between these front means 44 for driving in rotation and the generating means 15.

In a particular and preferred embodiment of the invention, the tube 14 is guided, near the entrance into the industrial plant 11 to be cleaned, by the front means 44 for driving in rotation. These means 44 are preferably formed by a rotary casing 40.

This rotary casing 40 is designed not only to ensure the guiding of the tube 14, but also to create and/or maintain a rotation motion, about its longitudinal axis or its longitudinal neutral fibre, of the tube 14. The rotary casing 40 advantageously includes motorisation means 50 for the longitudinal advance of the tube 14 controlling the translation movement of the latter.

The second rear means 33 for driving the tube 14 in rotation can advantageously be created at the level of the connecting means 20.

Figure 3:
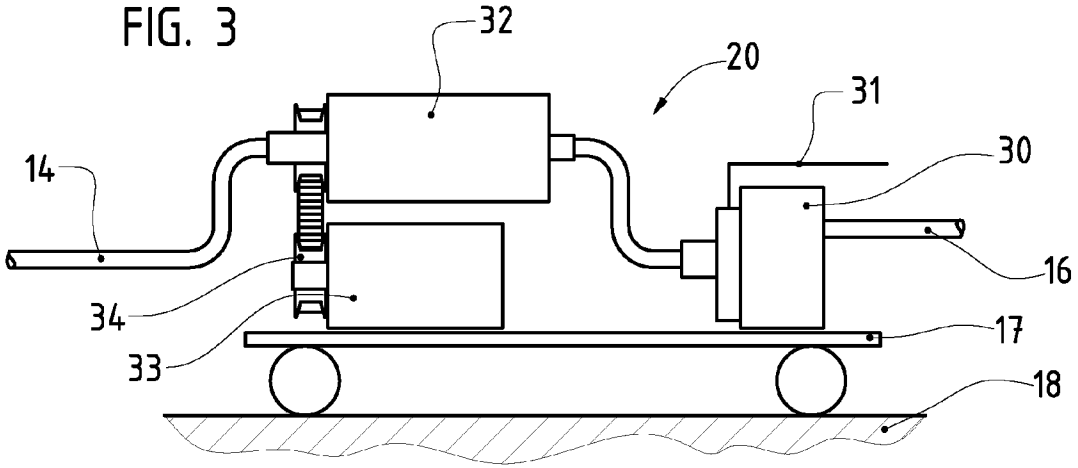

As can be seen in FIG. 3, downstream of the generating means 15, the fluid under very high pressure is brought to the means for connecting 20 to the tube 14 by a supply conduit 16. Of course, the fluid-supply circuit includes, if necessary, the adequate filtering means, not shown in the figures.

In a particular embodiment, at the entrance from the generating means 15 and the supply conduit 16, the means for connecting 20 to the tube 14 include means 30 for interrupting the fluid supply controlled by a control circuit 31. This interrupting means 30 are safety means designed for stopping the supply of fluid under high pressure to the tube 14 in the event of detection of the stoppage of rotation or/and the advance of the tube 14 or any other similar incident.

The means for connecting 20 to the tube 14 also include, downstream, a rear rotating joint 32 feeding directly the tube 14.

In a preferred embodiment, the means 20 also include means for causing the tube 14 to rotate, in the form of rear means 33 for driving in rotation, namely a motor, through rear transmission means 34.

The thus formed connecting means 20 are preferably mounted on a carriage 17, as can be seen in FIGS. 1 and 2. Each carriage 17 circulates on a rolling ramp 18. This ramp 18 is not necessarily rectilinear, in order to permit to adapt the device according to the invention to the topography of the premises in which the plant 11 is located, which is possible when the tube 14 is flexible.

Figure 4:
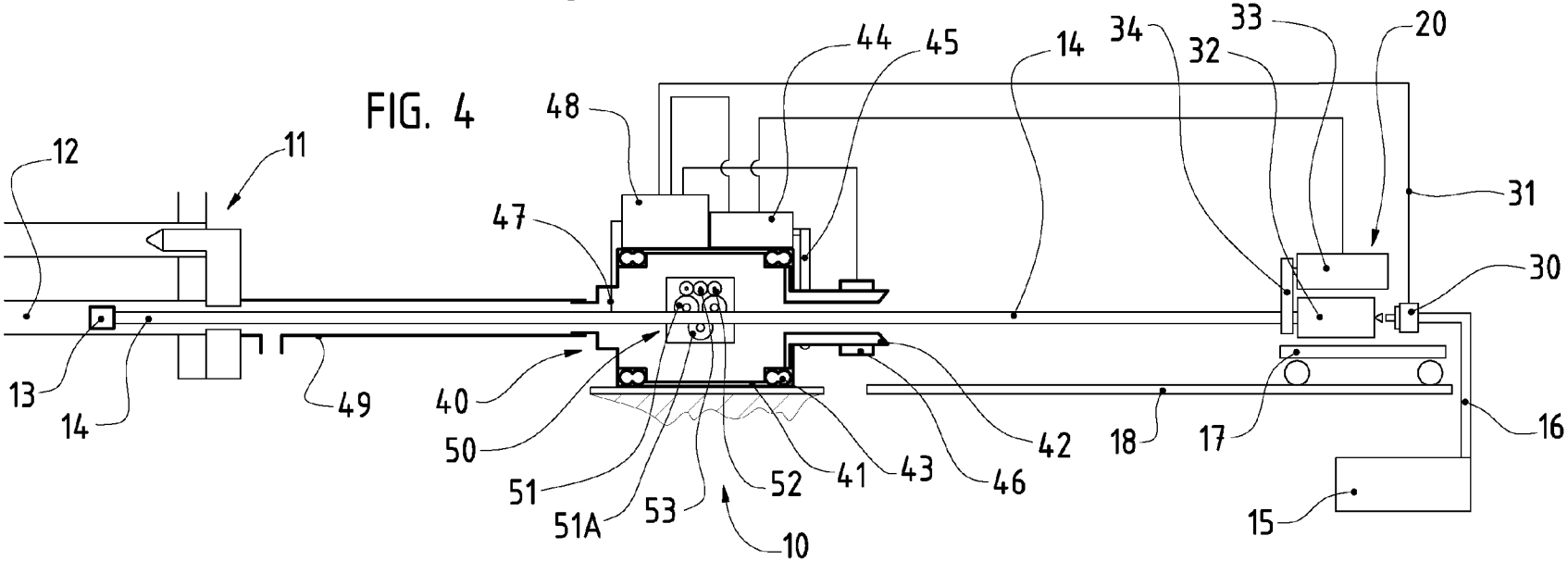

The tube 14 conveying a fluid under very high pressure can advantageously be contained in safety means, such as a jacket tube 49, shielded braided metal tubes, metal tubes namely of stainless steel in the form of bellows, or the like, as can be seen in FIG. 4.

In a particular embodiment, in particular in the case of rigid tubes, each carriage 17 can be designed to generate and/or maintain the translation movements of the tube 14.

As can be seen in FIG. 2, several sets of ramps, in this example three ramps 18A, 18B, 18C, can advantageously be arranged, preferably parallel to each other, to bear the carriages 17A, 17B, 17C, for causing the tubes 14A, 14B, 14C to rotate, for feeding an equal number of heads 13A, 13B, 13C.

This arrangement permits a proper control of the tubes 14 at their entering into the plant 11 to be maintained. It also permits to unfold, over their length, said tubes 14 outside the plant 11, and to position the generating means 15, which are generally voluminous, at an adequate location.

The invention permits to achieve an important saving of execution time: the operating time for removing the scale from a pipe with a diameter of 18 millimeters passes from about 15 minutes with the prior-art methods to about 6 minutes with the invention. Besides reducing the costs, the invention permits to reduce the times of immobilisation of the water boxes and, hence, the times of stoppage of the sections in power-production plants, namely in nuclear plants. The juxtaposition of several ramps permits, by treating several pipes in parallel, to further lower the costs and these times. For example, a plant with 6 tubes permits the operator to calculate the time of only 1 minute for cleaning each pipe.

Figure 8:
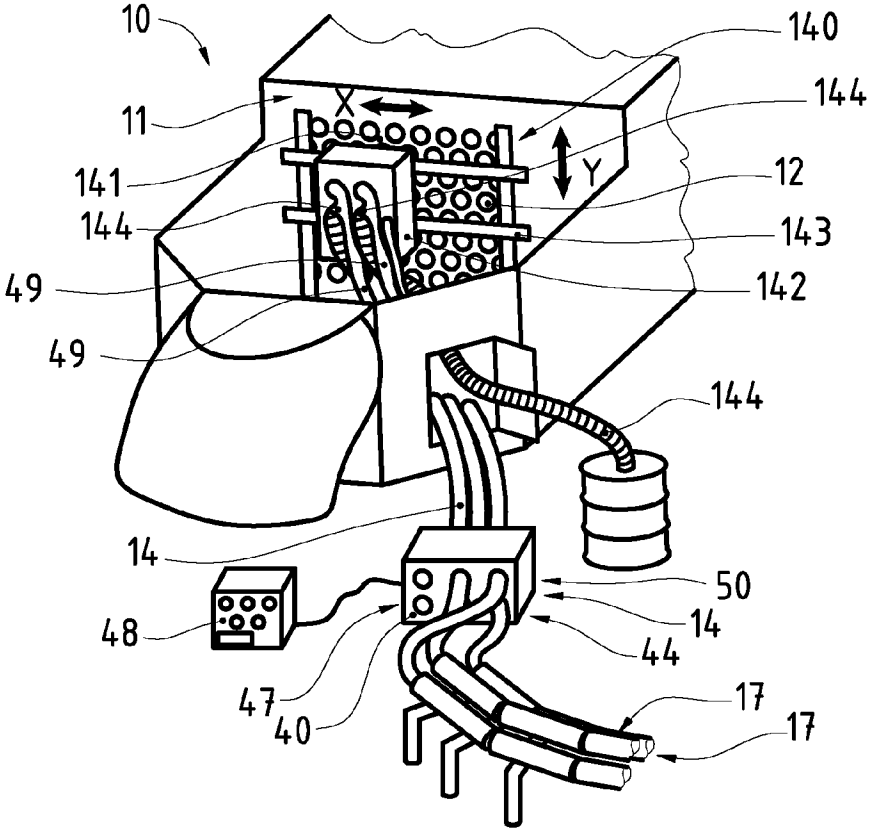
FIG. 8 is a schematic, partial and perspective representation of a plant including pipes to be cleaned, on the front face of which is arranged a device according to the invention including a plurality of cleaning tubes.

Advantageously, the invention also incorporates, in such a case, a positioning device 140 for inserting the tubes 14 into the bundles of pipes depending on the pitch of these bundles. The plants 11 with pipes 12, such as water boxes, include a lung with a generally flat front face 141. The positioning device 140 according to the invention preferably consists of a carriage 142 with cross-movements according to axes X, Y, as can be seen in FIG. 8, and namely with numerical control. This carriage circulates on a set 143 of guides, which are designed capable of being positioned very quickly on the front face 141, by mounting devices such as pneumatic jacks, or/and bolted elements, or the like. The numerical control of such a carriage with cross-movements also permits the operation without operator.

Particular attention has been paid to the protection of the operator. As can be seen in FIG. 8, a diversion conduit 144 can advantageously be installed, at the level of the entrance in the front face 141 of the plant 11, on the safety means 49 covering the tube 14, in order to collect, namely by sucking up and without any contact with the operator, the potentially pathogenic effluents proceeding from the scale removal. The operator is thus no longer exposed to the usual risk of legionnaire's disease in the case of combination of water and high temperature, and he can work in a clean environment, and his work is in addition less hard. It should be noted that the quantity of scale can be huge, in the range of 400 grams per pipe of 15 meters, which represents, for a water box of 30,000 pipes, 12 tons of dry scale. The device for implementing the invention preferably includes movable elements for filtering and separating these effluents, namely at the level of a vehicle. Another vehicle is preferably dedicated to the means for preparing the fluid, namely by filtering, and generating very high pressure 15. The rest of the equipment is modular, with small mass and size, so as to be capable of be mounted on the site, without hindrances, by operators who do not have heavy lifting apparatus at their disposal.

The operator has at his disposal, for conducting the method, a control casing, not shown in the figures, which is connected to management means 48.

To enhance the operator's protection, the tube 14 is connected to the head 13 by a special sleeve, referred to as nipple. This sleeve is maintained by a stop shoulder inside a casing, which is retained by a stop shoulder inside a casing 142 designed capable of being fixed on the front face 141 of a plant 11, such as a water box or a condenser, in which the pipes 12 are incorporated and, therefore, the operator cannot be in contact with the fluid under pressure.

The speed of rotation of the tube 14 is preferable between 0 and 1000 revolutions per minute, this speed being in no way restrictive.

Figure 5:
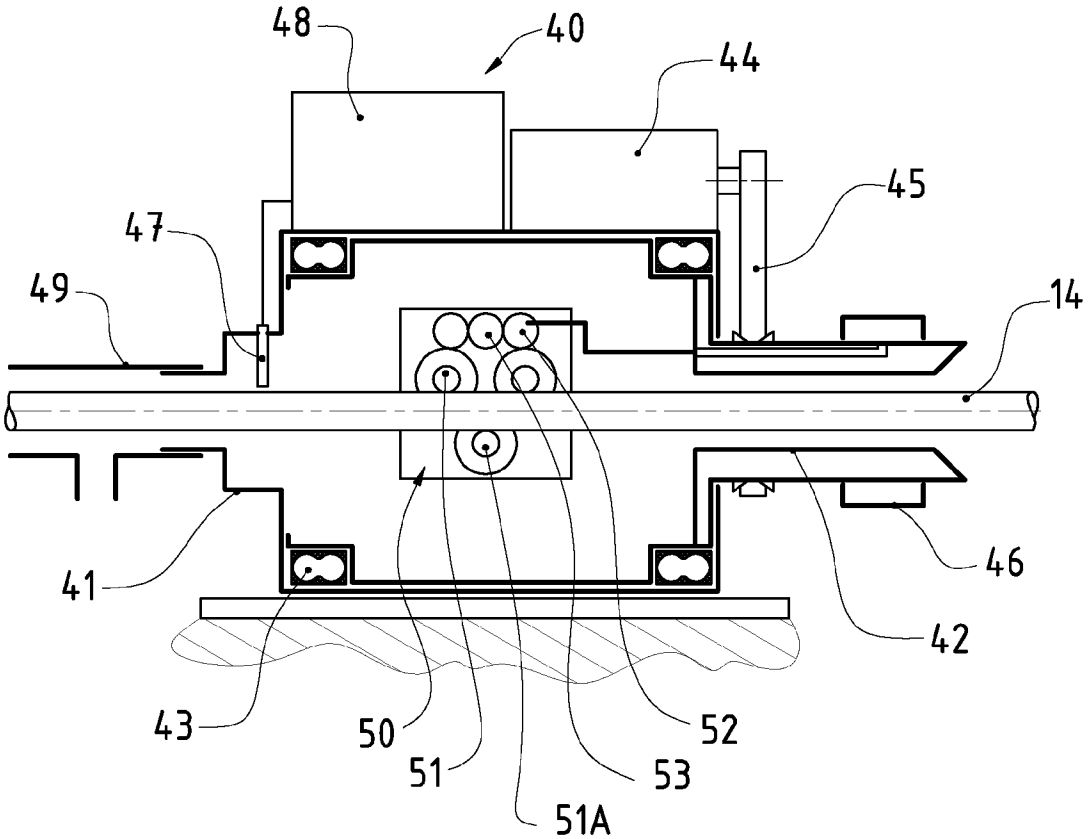
FIG. 5 is a detail of FIG. 4 representing the rotary casing according to the invention.

Referring again to the first front means for driving in rotation 44 and in a preferred embodiment, as can be seen in FIGS. 4 and 5, the tube 14 passes through a rotary casing 40.

The latter includes a crankcase 41 designed capable of being fixed to the structure near the plant 11 to be maintained, for example to the access lock to the bundle of pipes 12 of the plant 11.

The rotary casing 40 includes means for connecting a rotor 42 in a way integral in rotation with the tube 14. The tube 14 is designed capable of passing through the rotor 42. This rotor 42 is borne by a fixed crankcase 41 through guiding and supporting means 43, such as bearing blocks, or bearings or the like. The rotor 42 is driven, in a rotary motion about a longitudinal axis corresponding substantially to the longitudinal axis of the tube 14, by front means 44 for driving in rotation with respect to the crankcase 41, such as a motor, through front transmission means 45, such as a set of pulleys and belt, or the like.

In a preferred embodiment, the means for connecting the tube 14 integral in rotation with the rotor 42 are motorisation means 50 for longitudinal advance of the tube 14.

Figure 6:
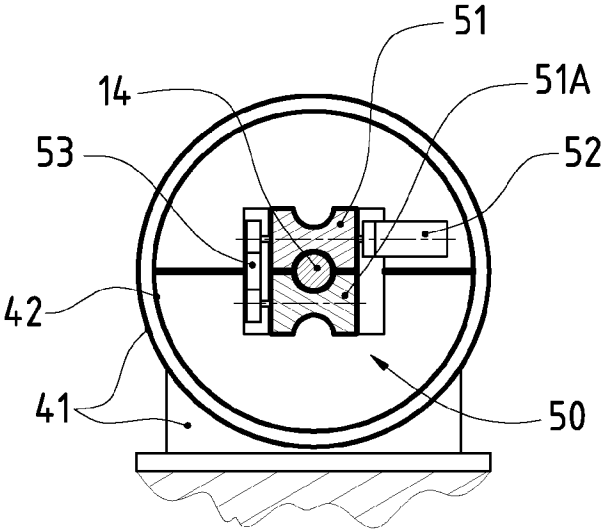
FIG. 6 is a schematic representation, seen in an axial direction, of a detail of the rotary casing according to the invention.

These motorisation means 50 preferably include, as represented in FIGS. 4, 5 and 6, at least one and preferably several rollers 51 and counter-rollers 51A, which are synchronised and driven by auxiliary driving means 52, namely a motor, through auxiliary transmission means 53.

The action of such rollers 51, 51A permits to push the tube 14 into the pipes 12 of the plant 11 to be maintained, or to extract it from same in the event of an incident or at the end of the work.

In the case of a device 10 including front and rear means for driving in rotation, one understands that it is possible, thanks to the installation of management or/and synchronisation means, to bring the tube 14 into synchronous rotation, about its longitudinal axis, over its full length. It is of course possible to implant, depending on the length of the tube 14 and the service constraints, a plurality of means for driving in rotation, which are all synchronised with each other.

One understands that for a proper control of the tube 14 before its entering into the plant 11 the means for generating the movement in rotation and the movement in translation of the tube 14, which are implanted at the level of the rotary casing 40, should preferably be driving with respect to other driving means the plant includes, namely at the level of the carriages 17.

In particular, the front means 44 for driving the tube 14 in rotation at the level of the rotary casing 40 should be synchronised with the rear means 33 and 34 located on the carriage 17, or/and also at other locations along the tube 14. Any twist or any deterioration of the tube 14 is thus avoided.

Likewise, in a particular embodiment, not shown in the figures, these motorisation means 50 can drive motorisation means for the longitudinal advance of the carriages 17 on the rolling ramps 18, or be synchronised with the latter.

The linear advance speed of the tube 14 is variable: in a preferred application, which is in no way restrictive, in the range of 300 to 2500 mm per minute in the cleaning phase, and in the range of 15 m per minute during the nearing and drawing-back movements in translation before and after cleaning.

In a preferred embodiment and as can be seen in the figures, the auxiliary driving means 52 are pneumatic means and are supplied with air through an axial front rotating joint 46 co-operating with the rotor 42.

The rotary casing 40 preferably also includes means 47 for detecting the rotation of the tube 14, connected to management means 48, namely formed of an automaton, which control and drive, on the one hand, the various driving means: motorisation means 50 for the longitudinal advance of the tube 14, front means 44 for driving the tube 14 in rotation, rear means 33 for driving the tube 14 in rotation, namely at the level of the carriage 17, and, on the other hand, through the control circuit 31, the means 30 for interrupting the fluid supply.

One understands that such detection means 47 can be installed at another location on the plant, and preferably as far as possible downstream. Their implanting at the level of the rotary casing 40 is preferred, because of the compactness of the plant and the grouping of all the apparatuses at the level of the crankcase 41, and because of its proximity to the plant 11.

Downward the rotary casing 40 toward the plant 11, the tube 14 is preferably protected by a supply jacket tube 49 until its entering into the bundle of pipes 12, where it is preferably used for recovering the effluents proceeding from the cleaning or scale-removal operation, and advantageously includes, in the vicinity of the plant 11, a T-fitting connected to a diversion conduit 144 for these effluents.

The device 10 advantageously includes means for marking, not shown in the figures, the longitudinal advance of the tube 14.

In a particular embodiment, the tube 14 includes marks over its length. Thus, a e.g. optical system can measure the position and the speed of advancing of the tube 14, and also detect an eventual blocking of same in its advance movement. Such a blocking can namely be caused by the huge quantity of scale in the pipes of the plant to be cleaned.

Such marking means are then interfaced with the management means 48, which trigger the actions necessary to avoid the equipment from being damaged.

These management means 48 also permit to detect wear of the motorisation means 50, for example of the rollers 51 or 51A, resulting into a sliding of the tube 14 with respect to same, namely in the case of a resistance force during the working phase.

Further technologies can be used for these marking means, namely inductive, mechanical technologies or the like.

The management means 48 advantageously adapt the rotation and translation parameters of the tube 14 according to those of the head 13, namely when the latter has an independent motorisation, for example electric motorisation. They can e.g. synchronise the speed of rotation of the tube 14, or calculate and regulate it according to the speed of rotation of a <<Roto-Jet®>>, which is either measured or controlled when this <<Roto-Jet®>> is also motorised.

The management means 48 ensure a full operation safety. Any abnormal resistance is taken into consideration: in particular, when the tube 14 does not rotate on itself or does not move longitudinally, after a very short delay, in the range of 0.5 to 1 second, the management means 48 control first of all the interruption of the generation of fluid under very high pressure at the level of the generating means 15, then the partial or total withdrawal of the tube 14, in order to avoid a jet of fluid at the level of the head 13 from remaining in place and cutting a pipe 12. This return travel can be performed at high advance sped, for example in 1 minute for a pipe of 15 meters.

When the rotation of the tube 14 is ensured, but its advance is stopped because of an obstruction of the pipe 12, a programming of the management means 48 permits to perform longitudinal to-and-fro movement cycles, for example over a travel distance of a few centimeters, even a total withdrawal after a predetermined number of cycles.

The position of the incident is then stored, which then permits a return of the head 13 into position for resuming the work. It should also be noted that the head 13 can circulate in the pipe 12 without fluid, in particular for measuring accurately its length. It is indeed important that the head 13 does not trespass, at the end of the pipe 12 opposite that of its insertion, in order to avoid its jets from deteriorating the anti-corrosion coatings the faces of the water boxes are generally provided with.

The management means 48 thus permit a fully automatic, or semi-automatic operation, with the possibility of causing a set of several tubes to work on a set of pipes or pipe by pipe, or also fully manually.

By way of an in no way restrictive example, the cleaning of the pipes can be performed with a speed of rotation from 0 to 1000 revolutions per minute, and an advance permitting to treat one meter of pipe in a time period between 0 and 120 seconds, preferably between 20 and 30 seconds. When the pipes are heavily covered with scale, one can use the possibility of operating in a reversible way, and several forth and back travels can prove necessary. It should be noted that pure water will do for such a scale removal, the combination of the speed of longitudinal advance, the speed of rotation and the pressure of the jet is enough to pickle the scale. It should be noted that, when the scale is not hard, one can use a speed of rotation of the tube of 500 revolutions per minute, even more.

The device 10 with a rotary casing 40 according to the invention provides, compared to the prior-art systems, a highly regular movement, which permits to perform quality work. For cleaning pipes with a thickness from 0.7 to 0.8 mm and diameters from 15 to 25 mm, it is possible to work with pressures much higher than 15 $10^7$ Pa, namely 20 $10^7$ Pa to 25 $10^7$ Pa in the case of brass pipes, and up to 38 $10^7$ Pa bar depending on the tests performed, whereby this value does in no way constitute an upper limit, but a threshold used depending on the technologies available at costs consistent with an industrial plant.

This regular movement constitutes one of the essential advantages of the invention. It permits to provide answers for the operators who, while wanting the removal of scale from their pipes, do not want a blank treatment of these pipes, but maintaining a surface layer resulting from a previous surface treatment, for example a layer of particular oxides, for example further to <<vaccinations>> of brass pipes by acid attacks, or also a plasticized coating or the like. The combination of the speed of rotation of the tube 14, its advance, the fluid flow rate, and the angle of projection of the jets from the front nozzles of the head 13 permits performing a test on a first pipe 12 until validation; the process is then perfectly reproducible on all other pipes 12 of the bundle 11 involved, thanks to the perfect control of all the parameters.

The rotary casing 40 according to the invention provides high working safety thanks to the control of the parameters, and permits in particular avoiding any breaking of the pipes 12 to be cleaned. Its small size, in the range of 350 cubic mm, permits to install it in the direct vicinity of the entrance of the plant 11 to be cleaned. The supply tubes 49 can accommodate several flexible tubes 14 corresponding to the cleaning of different pipes 12 of the plant 11 to be cleaned. Because of the small size of such rotary casings 40, one can indeed juxtapose several of them, in order to further increase the number of pipes 12 cleaned simultaneously and, hence, very considerably reduce the time of immobilisation of the industrial plant 11 to be cleaned. In such a multi-tube and multi-carriage version, it is interesting to group the rotary casings, even to integrate them in one and the same crankcase. It should be noted that the distance between this crankcase and the entrance of the tubes into the lung to be cleaned is then variable. The flexibility of the jacket tube 49 protecting the tube 14 and that of the latter itself permit to arrange, for various circuits, tube sections of the same length, those corresponding to the entrances farthest away from the rotary casing in the lung including less meanders than those relating to the nearest entrances, which then adopt a snake-shaped form made possible by this flexibility.

It should also be noted that the rotary casing 40 is fully autonomous in terms of motorisation, and can be used alone, fully independently from a device with a movable carriage 17 as described above.

The fluid used in the method and the device according to the invention is, in a preferred version, formed of water or an aqueous solution.

In another particular application, this fluid is a liquid gas. The device according to the invention then includes, at different locations, means for measuring and regulating the temperature of the tube 14, in the form of substations, so as to bring the fluid to the desired temperature at the end of the tube 14 in a pipe 12, namely at the level of the head 13.

A particular application consists in projecting liquid nitrogen, the management means 48 then preferably regulate the substations, in order to ensure a temperature close to −147° C. at the level of the end of the tube 14 in a pipe 12, namely at the level of the head 13. In this way are ensured, at the exit, jets in liquid form and, afterwards, a quick evaporation permitting to avoid any treatment of effluent.

Other fluids can be projected, namely surface-protection agents, such as paints, oxides, or the like.

The operator of an industrial plant provided with condensers cleaned according to the method and with the device of the invention finds multiple advantages: a power gain for the section involved in the case of a power-production plant, a lowering of the hazards and difficulties for the operators, a reduced time of intervention for maintenance, which quickly restores the availability of the means, lower cost for the scale removal, a reduction of the liquid effluents, a possibility of total scale removal, which ensures the gain of efficiency at the level of the condenser, which brings restores the nominal efficiency of the new plant after scale removal, a high reduction of the cleaning water consumption, or also, after total scale removal, a possibility of performing checks, namely by means of Foucault currents, to follow the wear of the pipes, which is impossible as long as scale remains inside.

Other uses of the invention are interesting: chemistry, petrochemistry, sea-water desalting plants. Indeed, the invention, here described in the preferred application of scale removal, is as efficient for the removal of other solid residues such as chlorides, nitrides or the like.

The invention claimed is:

1. Method for cleaning a pipe by the action of a fluid under very high pressure, said method comprising:

causing a fluid under very high pressure higher than $15\times10^7$ Pa to pass through a flexible tube, driving said flexible tube in rotation about a longitudinal axis of said flexible tube by means of rear means for driving the tube in rotation situated at a mobile carriage circulating on a rolling ramp, said mobile carriage having first motorisation means for longitudinal advance of the tube, said first motorisation means for longitudinal advance of the tube being configured for generating and/or maintaining a translation movement of said flexible tube, subjecting said flexible tube to actions of second motorisation means for longitudinal advance of the tube and of front means for driving the tube in rotation about its longitudinal axis, said second motorisation means for longitudinal advance of the tube and said front means for driving the tube in rotation being situated at a rotary casing, regulating said first and second motorisation means for longitudinal advance of the tube and said rear and front means for driving the tube in rotation by means of management means and means for detecting the rotation of the tube and/or pinpointing the longitudinal advance of the tube, wherein said rotary casing is autonomous in terms of motorisation, and can be used alone, fully independently from said mobile carriage, driving said first motorisation means for longitudinal advance of the tube by means of said second motorisation means for longitudinal advance of the tube, or synchronizing said second motorisation means for longitudinal advance of the tube with said first motorisation means for longitudinal advance of the tube, driving said first and second motorisation means for longitudinal advance of the tube and said rear and front means for driving the tube in rotation independently from each other by means of said management means, guiding said flexible tube near an entrance of said pipe so as to clean the pipe by means of the fluid under very high pressure passing through the flexible tube.

2. Method according to claim 1, wherein the device comprises a head fixed to an end of the tube, and the management means controls a longitudinal movement and a position of said tube, a position of said head, a variable linear advance speed of said tube, nearing and drawing-back movements in translation of said tube, a rotation movement of said tube, and a circulation of said fluid in said tube.

3. Method according to claim 1, wherein said fluid used in the method is formed of water or an aqueous solution, or a surface-protection agent, or a paint, or an oxide, or a gas, or a liquid gas, or liquid nitrogen.

4. Method according to claim 1, wherein said management means controls a means for measuring and regulating a temperature of said tube so as to bring said fluid to a desired temperature at an end of said tube located inside a pipe in which said tube has been inserted.

5. Method according to claim 1, wherein said fluid used in the method is under a pressure between $15\times10^7$ Pa and $38\times10^7$ Pa, with a flow rate between 10 and 15 liters per minute, a speed of rotation of said tube is between 0 and 1000 revolutions per minute, and a longitudinal advance speed of said tube is set so that 1 meter of pipe is cleaned in a time length between 0 and 30 seconds.

6. Method according to claim 5, wherein a longitudinal advance speed of said tube is set so that 1 meter of pipe is cleaned in a time length between 0 and 4 seconds.

7. Device for cleaning with a fluid under high pressure in particular for cleaning bundles of pipes such as an exchanger or the like, wherein said device comprises:

means for generating a fluid under very high pressure higher than $15\times10^7$ Pa for feeding a tube, a carriage circulating on a rolling ramp, rear means for driving the tube in rotation about a longitudinal axis of said tube, said rear means for driving the tube in rotation being situated at the carriage, said carriage having first motorisation means for longitudinal advance of the tube, said first motorisation means for longitudinal advance of the tube being configured for generating and/or maintaining translation movements of said tube, a rotary casing, second motorisation means for longitudinal advance of the tube, said second motorisation means for longitudinal advance of the tube being situated at the rotary casing, front means for driving the tube in rotation about its longitudinal axis, said front means for driving the tube in rotation being configured for being located near said bundle of pipes and synchronised with said rear means for driving the tube in rotation, said front means for driving the tube in rotation being situated at the rotary casing, management means configured for driving said first and second motorisation means for longitudinal advance of the tube and said rear and front means for driving the tube in rotation, and means for detecting the rotation and/or pinpointing the longitudinal advance of the tube, said means for detecting being situated at said rotary casing, wherein said rotary casing is autonomous in terms of motorisation, and can be used alone, fully independently from said mobile carriage, wherein said second motorisation means for longitudinal advance of the tube is configured to drive said first motorisation means for longitudinal advance of the tube or to be synchronised with said first motorization means for longitudinal advance of the tube, and wherein said rear means for driving the tube in rotation is inserted between said rotary casing and said means for generating the fluid under very high pressure.

8. Device according to the claim 7, wherein said management means is configured for driving independently said first and second motorisation means for longitudinal advance of the tube, said front means for driving the tube in rotation, and said rear means for driving the tube in rotation.

9. Device according to the claim 7, wherein said rotary casing, in which the tube is designed to be inserted and guided, includes means for connecting to said tube, integral in rotation, a rotor driven in rotation about a longitudinal axis corresponding substantially to the longitudinal axis of the tube, wherein the tube is configured for passing through this rotor, the rotor being driven in rotation with respect to a fixed crankcase by said front means for driving the tube in rotation, and wherein said connecting means are said second motorisation means for longitudinal advance.

10. Device according to claim 7, which includes at least one head configured for projecting a cleaning jet at one end of said tube, said head being fixed to said end of said tube and said head including:

at least one insert configured for generating outside said head at least one jet of fluid, at least one internal channel configured for bringing fluid under pressure to said at least one insert, and at least one side insert configured for projecting a side jet, wherein said side insert is made out of a hard material having a hardness of more than 2000 megapascals and drilled to a calibrated diameter of less than 0.150 mm.

11. Device according to the claim 10, wherein said head includes one or several rear inserts configured for projecting towards a downstream side of said head one or several jets in order to at least compensate for axial forces due to one or several jets oriented towards an upstream side of said head proceeding from other inserts included in the head.

12. Device according to claim 10, wherein said side insert is made out of sapphire.

13. Device according to claim 7, which includes a positioning device for inserting one or several tubes into a plant including pipes to be cleaned, wherein the positioning device includes a carriage with cross-movements, circulating on a set of guides configured for being positioned on a front face of said plant.

14. Device according to claim 7, which includes a diversion conduit connected, in an area of an entrance at a front face of a plant including pipes to be cleaned, to safety means or to a jacket tube protecting the tube, for collecting effluents without any contact with the operator.

15. Device according to claim 7, wherein said management means are configured for controlling at least one of (i) when said tube does not rotate, first, an interruption of the generation of fluid under very high pressure in an area of the generating means, then, a partial or total withdrawal of the tube from a pipe in which it has been inserted, and (ii) when said tube rotates, but does not perform a longitudinal movement, a partial or total withdrawal of the tube from a pipe in which it has been inserted.

16. Device according to claim 7, wherein said tube carries a head and includes marks over a length of said tube, wherein marking means are configured for measuring a position and a speed of advance of said tube in a pipe in which said tube has been inserted, and of detecting an eventual blocking of same in the advance of said tube in the pipe, said marking means being interfaced with said management means so as to trigger actions necessary to avoid the device from being damaged and to ensure full operational safety, by taking into consideration any abnormal resistance, wherein, if the advance of said tube is stopped because of an obstruction of the pipe, said management means are configured for performing at least one of:

(i) longitudinal to-and-fro movement cycles, and (ii) a total withdrawal, with storing of a position of the incident, to permit a return of said head into position for resuming the work.

17. Device according to claim 7, wherein said tube is flexible.

* * * * *